United States Patent [19]

Loch et al.

[11] 4,128,287

[45] Dec. 5, 1978

[54] HOUSEHOLD APPLIANCE WITH A BASE SETBACK ON THE FRONT SIDE THEREOF

[75] Inventors: Friedhelm H. Loch, Munich; Hans Mailänder, Heidenheim; Heinz Riemath, Giengen; Richard Schmid, Giengen; Ernst Stickel, Giengen, all of Germany

[73] Assignee: Bosch-Siemens Hausgerate GmbH, Stuttgart, Germany

[21] Appl. No.: 802,552

[22] Filed: Jun. 1, 1977

[30] Foreign Application Priority Data

Jun. 4, 1976 [DE] Fed. Rep. of Germany ..... 2626202

[51] Int. Cl.[2] ..... A47B 91/02

[52] U.S. Cl. ..... 312/253; 312/140.1; 312/210; 312/278

[58] Field of Search ..... 312/253, 278, 296, 204, 312/210, 140.1

[56] References Cited

U.S. PATENT DOCUMENTS

| | | | |
|---|---|---|---|
| 1,321,731 | 11/1919 | Gill | 312/140.1 |
| 2,211,428 | 8/1940 | Matot | 312/140.1 |
| 2,270,710 | 1/1942 | Ring | 312/253 |
| 2,295,304 | 9/1942 | Stoddard et al. | 312/204 |
| 2,664,258 | 12/1953 | Lanier | 312/253 |
| 2,772,938 | 12/1956 | Oculato | 312/210 |
| 2,775,500 | 12/1956 | Etherington | 312/210 |
| 3,004,814 | 10/1961 | Schulbe | 312/140.1 |
| 3,169,811 | 2/1965 | Stewart | 312/140.1 |

*Primary Examiner*—Victor N. Sakran
*Attorney, Agent, or Firm*—Herbert L. Lerner

[57] ABSTRACT

A household appliance such as a dishwasher, washing machine, stove and the like, with a base setback on the front thereof, in which the facing of the base setback is constructed from two wall plates, each of which may be shortened to a desired width. One of the wall plates extends in the plane of the front side of the appliance while the other wall plate is fastened to a lower edge zone of the first plate. The second wall plate extends parallel to the base of the appliance with its edge facing from the front resting against a base plate movable horizontally of the appliance. This permits varying the depth and height of a base setback of an appliance in a simple efficient manner to match the base setback of adjacent cabinets.

10 Claims, 4 Drawing Figures

Fig. 3
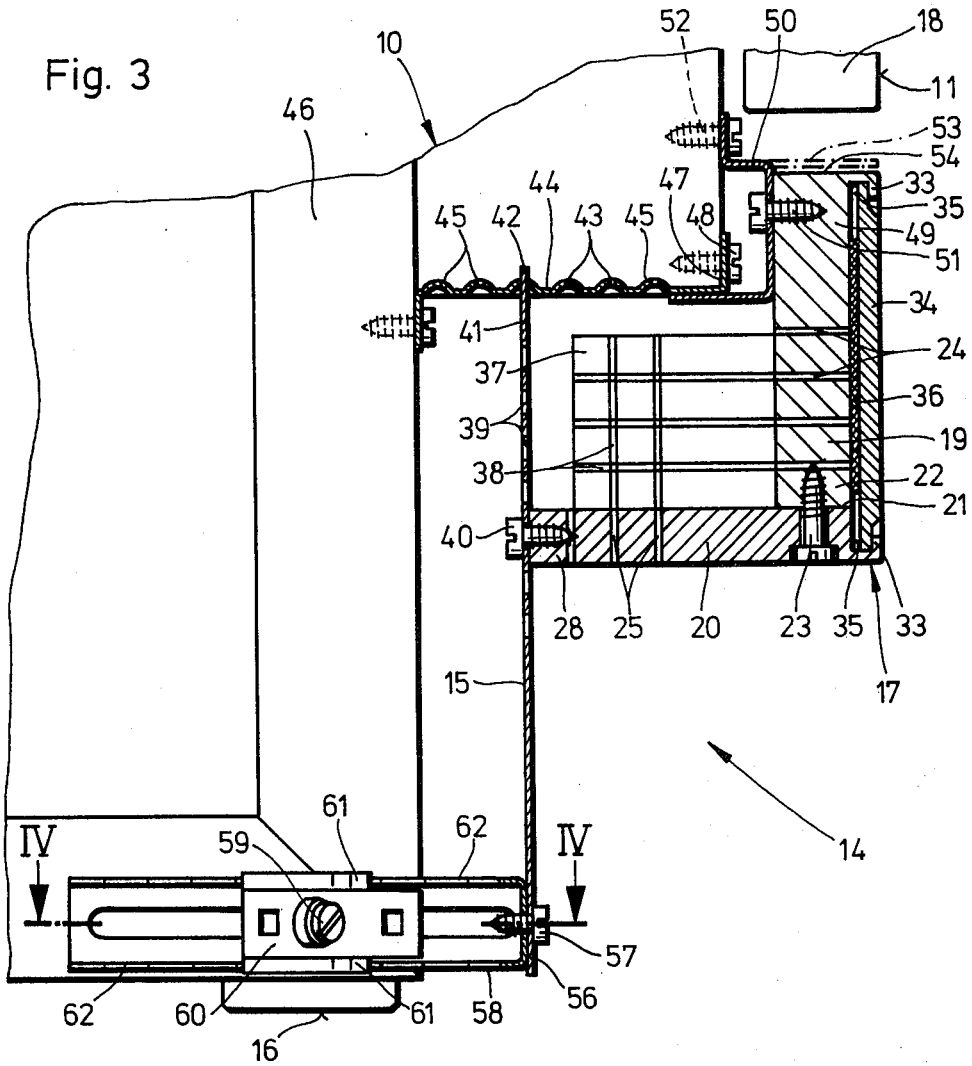
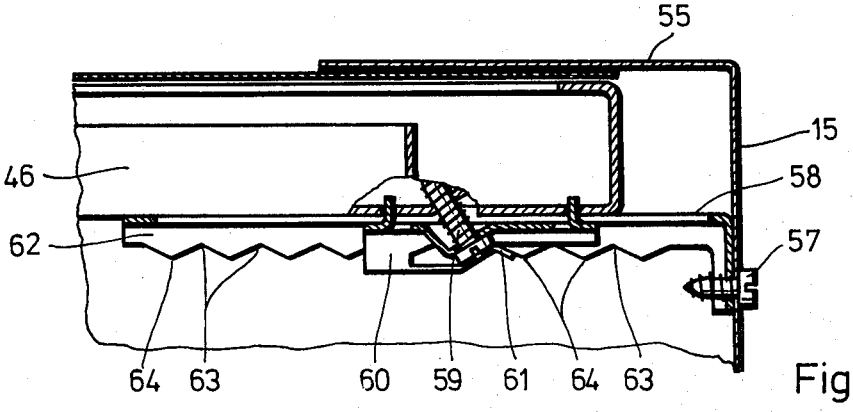
Fig. 4

HOUSEHOLD APPLIANCE WITH A BASE SETBACK ON THE FRONT SIDE THEREOF

BACKGROUND OF THE INVENTION

1. Field of the Invention

The invention relates to a household appliance, particularly a dishwasher, a washing machine, a stove or the like, with a base setback on the front side thereof, having a facing with a vertically disposed base plate parallel to the front side of the appliance and parallel to the base of the appliance.

2. Description of the Prior Art

In one known dishwasher of this type with a door on the front side, the base plate is brought up to the lower edge of the door and is provided underneath the latter with a facing extending up the plane of the front side of the appliance. When this dishwasher is installed in a lineup of kitchen cabinets, it is often necessary to match the base setback of the machine to the setback of the adjacent cabinets. For this purpose, the facing supplied with the machine must be exchanged for one of different width. This causes additional costs and furthermore, the depth of the base setback cannot be matched to the setback of the kitchen cabinets.

SUMMARY OF THE INVENTION

An object of the invention is to overcome the drawback of the known design by providing a household appliance in which the base setback can be varied in a simple manner as to height as well as depth.

With the foregoing and other objects in view, there is provided in accordance with the invention a household appliance, such as a dishwasher, washing machine, stove and the like, with a base setback on the front thereof, which base setback has a vertically disposed base plate parallel to the front side of the appliance and a facing parallel to the base of the appliance, the appliance having a setback which can be modified to match an adjacent cabinet with a facing constructed from two wall plates, each of which may be shortened to a desired width, one of the wall plates extending at least approximately in the plane of the front side of the appliance, with the other, second wall plate fastened to the lower edge zone of the first wall plate, the second wall plate extending parallel to the base of the appliance with its edge zone facing away from the front resting against a base plate of the appliance, the base plate being movable toward the front and toward the rear of the appliance into planes which are parallel to the front side of the appliance.

Although the invention is illustrated and described herein as embodied in a household appliance with a base setback on the front side thereof, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

FIG. 3 is a cross-sectional view through the base region on the setback side of the dish washer in ¾ actual size taken along line III—III in FIG. 1, and FIG. 4 is a cross section through a support shoe supporting the base plate in actual size, taken along line IV—IV in FIG. 3.

DETAILED DESCRIPTION OF THE INVENTION

Figure 1:
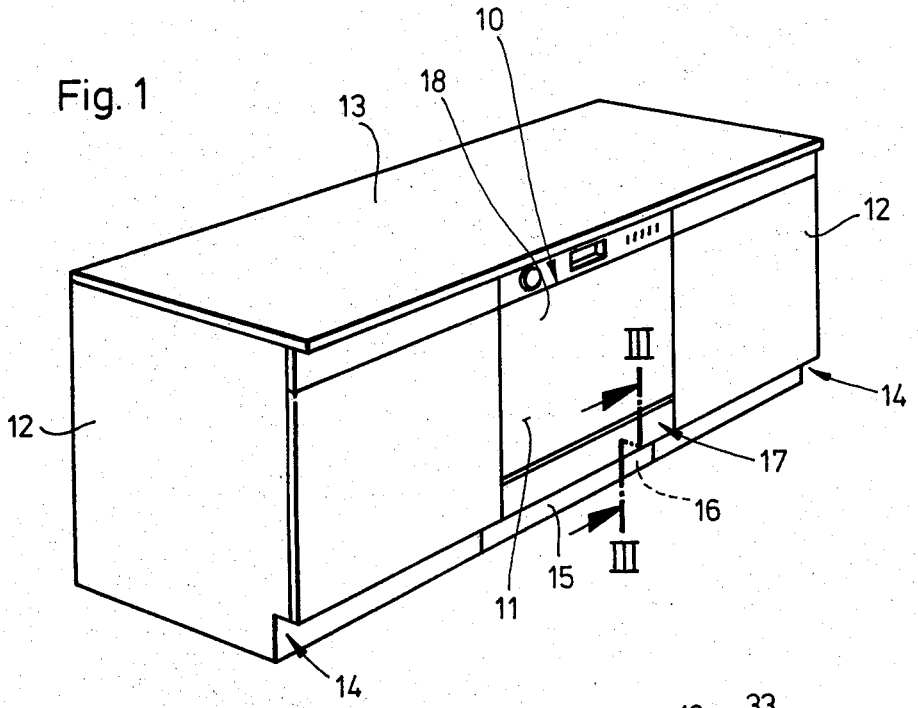
FIG. 1 is a perspective view of the dish washer arranged between kitchen cabinets.

The facing is constructed from two wall plates which are arranged at right angles to each other. The width of each wall plate can be shortened. One wall plate is disposed at least approximately in the plane of the front side of the appliance, while the other, second wall plate which is fastened to the lower edge of the first wall plate, extends parallel to the base of the appliance and is supported with its front-side edge zone against the base plate. The base plate can be moved into planes parallel to the front side of the appliance.

This is advantageous inasmuch as the base setback can be matched in a simple manner to the base setback of adjacent kitchen cabinets by shortening the height of the front-side wall plate as well as by shortening the wall plate extending parallel to the base and moving the base plate in depth. For this purpose, according to one practical embodiment of the invention, the facing wall plate extending parallel to the base of the appliance as well as the front-side wall plate of the facing have narrow longitudinal slots which run parallel to the base plate with regular pitch, i.e. the longitudinal slots are evenly spaced, with the path of each slot interrupted by separable bridges. The wall plates of the facing can therefore be matched to the dimensions of the desired base setback by cutting the separable bridges at the desired width with a saw.

The base plate is connected at its lower edge zone on each end-section side to an extendible support shoe on each end-section, which support shoe extends between the base plate and the household appliance. Adjustment of the extension of the shoes in conjunction cutting the wall plate to the desired width permits matching the setback of adjacent kitchen cabinets.

As an example, a dish washer is shown in the drawing, having a base setback, the height and depth of which is variable and which is defined by a facing and a base plate of the machine.

Referring specifically to the drawings, a dishwasher designated generally by numeral 10 is aligned with its front side 11 flush with the surfaces of two adjacent floor cabinets 12 and covered, together with the latter, by a common work surface 13 (FIG. 1). The dishwasher 10 and the floor cabinets 12 have a base setback 14 which has the same height and depth dimensions. In the case of the dishwasher 10, the setback includes a vertically disposed base plate 15 parallel to the front side 11 and a facing 17 parallel to the machine base 16. The facing extends close to the door 18 of the dishwasher 10, which swings open toward the front.

Figure 2:
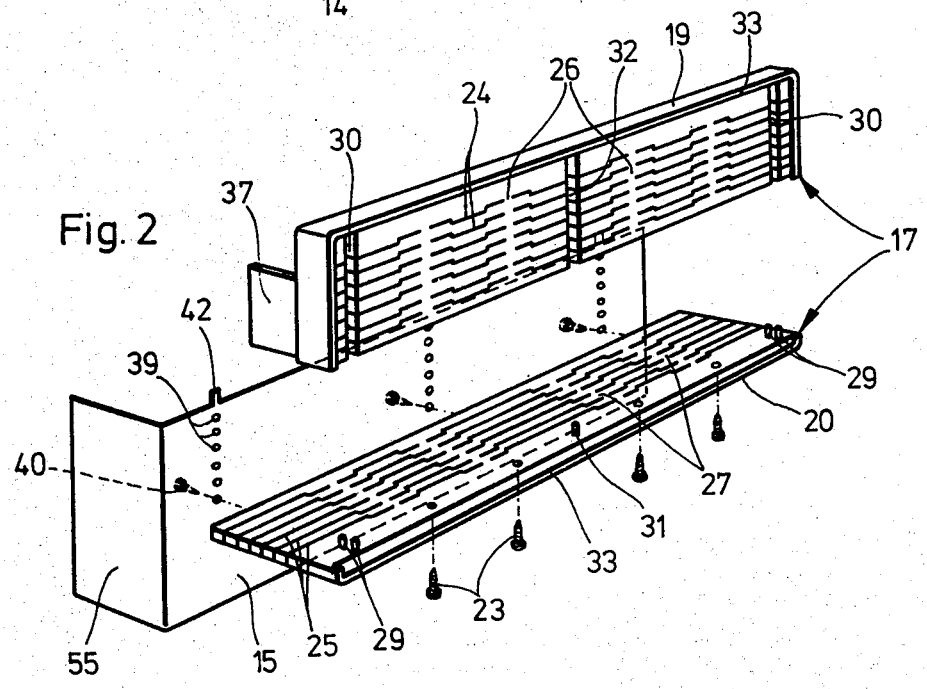
FIG. 2 is an exploded view of the facing, shown enlarged, and of the base plate.

The facing 17 is constructed from two wall plates 19 and 20 which consist of plastic or wood and are arranged at right angles to each other. Plate 19 extends in the plane of the front side 11 of the machine, while the other wall plate 20 extends parallel to the base plane 16 of the appliances (FIGS. 2 and 3). The two wall plates 19 and 20 of the facing 17 meet along an area or line 21 extending in a horizontal plane, where they are joined together from the underside of the wall plate 20 disposed parallel to the base 16 of the appliance by several screws 23 which go through wall plate 20 and engage the lower edge zone 22 of the front-side wall plate 19. The width of the wall plates 19 and 20 of the facing 17, which are shown in FIG. 2 with their original full width, can be shortened; they are provided for this purpose with narrow longitudinal slots 24 and 25 which run parallel to each other with uniform pitch. In the case of the front-side wall plate 19, the longitudinal slots 24 run parallel to line 21; in the case of the wall plate 20 which is disposed parallel to the base 16, the longitudinal slots 25 are arranged parallel to the base plate 15. The longitudinal slots 24 and 25 in the wall plates 19 and 20 of the facing 17 extend over nearly the entire length of the wall plates and are interrupted in their path by several separable bridges 26 and 27, respectively. The longitudinal slots 24 and 25 in the wall plates 19 and 20 of the facing 17 are offset parallel from the axis of the slots in the region adjacent to the bridges 26 and 27, in order to make finishing of the separated bridges of the wall plates, which are shown in FIG. 3 with their width shortened, unnecessary at the points where the front-side wall plate 19 meets with its lower edge zone 22, the wall plate 20 extending parallel to the base 16, or where the wall plate 20 with its edge zone 28 facing away from the front bears against the base plate 15.

The wall plate 20, which extends parallel to the base 16 of the machine, has at its two end sections, in the vicinity of area 21, two pairs of spaced vertical posts 29. One post 29 on the front side engages a vertical slot 30, open toward the front, of the front-side wall plate 19 of the facing 17. The other post 29 engages a slot which is open toward the base plate 15. The position of the two wall plates 29 and 20 of the facing 17 in the depth direction of the dishwasher 10 is thereby fixed before the two wall plates 19 and 20 are bolted together. To fix the two wall plates 19 and 20 relative to each other, the wall plate 20 extending parallel to the base 16 is provided with a post 31, which engages without play a vertical slot 32, which is open toward the front, of the front-side wall plate 19 of the facing 17.

Facing 17 has an extension or lip 33, which is of angular cross section and runs around its edges. Lip 33 extends over a cover plate 34 disposed in front of the facing 17. The cover plate 34, which is decorated to match the facing 17 to the adjacent floor cabinets 12 and is provided to cover up the longitudinal slots 24 in the front-side wall plate 19, fits along its rim into a slot 35 formed by the extension 33 and the wall plates 19 and 20. An elastic body 36 in the form of a foam-material strip is placed between the facing 17 and the cover plate 34. The elastic body presses against the extension 33 from the back in order to compensate for play of the cover plate 34 in the slot 35.

The front-side wall plate 19 of the facing 17 is further provided at its two end sections with a wall-like extension 37, which has crosswise slots 38 at uniform spacings in order to make the extension readily adaptable to the new dimensions of the facing 17 when the width of the wall plates 19 and 20 is shortened.

Shortening the width of the front-side wall plate 19 results in a lifting of the wall plate 20 which extends parallel to the base 16. To fasten this wall plate 20 at different heights, the base plate 15 has holes 39, arranged with uniform pitch, i.e. evenly spaced, on top of each other. Screws 40 passing through holes 39 of base plate 15 are screwed to the wall plate 20, extending parallel to the base 16 at its edge zone 28 facing away from the front to the base plate 15. If the wall plate 20, extending parallel to the base 16 of the machine, of the facing 17 is shortened, the base plate 15 must be moved to another plane extending parallel to the front side 11 of the machine. To this end, the base plate 15 has at its upper edge 41 on the end-section side, vertical tab-like extensions 42 which engage with cutouts 43 of a support sheet 44 which extends parallel to the base 16 of the machine. Each of the cutouts 43 has the shape of a slot corresponding to the shape of the extension 42 and is arranged in a depression 45 of the support sheet 44, so that the extensions 42 can be inserted into the cutouts 43 more easily.

The support sheet 44 extends substantially horizontally over the entire width of the dishwasher 10 and is screwed, on the side away from the front, to a frame 46 running along both sides of the dishwasher 10. At its front edge 47, the support sheet 44 is fastened to the dishwasher 10 by screws 48. Along the upper edge 49 of the front-side wall plate 19 extends a horizontal ledge 50, which is connected to the front-side wall plate 19 of the facing 17 by screws 51 and also connected, just below the door 18, to the dishwasher 10 by screws 52. The ledge 50 may also be provided with a horizontal flange 53, which is shown with dash-dotted lines in FIG. 3 and covers up the narrow side 54 of the front-side wall plate 19 of the facing to prevent liquid from dripping from the door 18 onto the front-side wall plate 19 of the facing 17 when the dishwasher is being loaded. The base plate 15 is further provided with rectangularly angled-off end sections 55,i.e. at right angles to base plate 15, which sections 55 extend along the outside of the dishwasher 10 and prevent lateral openings between the base plate and the dishwasher from being brought about when the base plate is moved toward the front side 11 of the dishwasher (FIG. 4). The base plate 15 at its lower edge 56 is connected on each end section side by screws 57 to a respective support shoe 58 which extends horizontally between the base plate and the dishwasher 10. The shoe 58 is bolted to the frame 46 of the dishwasher 10 by means of a clamp 60 and a screw 59. The clamp 60 has two spring tabs 61 each of which engage a wavy edge of a wall section 62 of the support shoe 58. The troughs 63 and peaks 64 of the waves of the wavy-edge wall section 62 which extends along the support shoe 58 follow each other at a regular pitch. This pitch, like that of the longitudinal slots 24 and 25 in the wall plates 19 and 20 of the facing 17 as well as that of the holes 39 in the base plate 15 is 10 mm. After removing base plate 15 and loosening the screw 59, the support shoe 58 can therefore be moved a distance of 10 mm or a multiple thereof, detented against the force of the spring tabs 61 relative to the dishwasher 10.

When the dishwasher 10 is shipped, the front-side wall plate 19 as well as the wall plate 20, extending parallel to the base 16, of the facing 17 have their maximum width, so that the base setback 14 has little height and much depth. Also, the facing 17 is provided with a cover plate 34 of neutral color and decor. At the installation site of the dishwasher 10, the base setback 14 is matched to the adjacent floor cabinets 12. To this end, the width of the wall plate 19 on the front side is shortened at its lower edge 22 and/or the wall plate 20, which is parallel to the base 16, at the edge 28 facing away from the front by one pitch division or a multiple thereof. Similarly, the extension 37 of the front-side wall plate 19 as well as the cover plate 34 are made smaller according to the changed dimensions of the facing 17, or a cover plate corresponding to the decor of the adjacent cabinets 12 is made.

For installing the facing 17, the ledge 50 is first fastened by means of the screws 51 to the upper edge 49 of the front-side wall plate 19. Subsequently, the cover plate 34 is inserted into the slot 35 of the front-side wall plate 19 and the facing 17 is completed by joining the wall plate 20 which extends parallel to the base 16. The posts 29 and 31 engage then with the corresponding slots 30 and 32 of the front-side wall plate 19. At the same time, the cover plate 34 is fitted into the slot 35 of the wall plate 20 extending parallel to the base 16. Subsequently, the wall plate 20 extending parallel to the base 16 is connected to the front-side wall plate 19 by means of the screws 23. The wall plate 20 extending parallel to the base 16 of the facing 17 is now fastened to the base plate 15 by means of the screws 40 in accordance with the width of the front-side wall plate 19 at the proper height. After the screws 59 are loosened, the support shoes 58 are moved lengthwise against the force of the spring tabs 61 according to the width of the wall plate 20 extending parallel to the base 16 and are secured with the clamp 60 by tightening the screw 59. Thereupon the facing 17, supplemented by the base plate 15 and the ledge 50, is placed on the dishwasher 10. The tabs 42 of the base plate 15 engage here with the corresponding cutouts 43 of the support sheet 44. Subsequently, the ledge 50 is bolted to the dishwasher 10 by means of the screws 52, and the base plate 15 to the support shoes 58 by means of the screws 57.

There are claimed:

1. In a housing appliance, such as a dishwasher, washing machine, stove and the like, with a base setback on the front thereof, the improvement comprising:

(a) a base setback having a vertically disposed base plate parallel to the front of the appliance, and facing means composed of two separate wall plates (b) said two wall plates disposed at right angles to each other with one wall plate disposed in the plane of the front of the appliance and the other wall plate secured to the lower edge zone of the first wall plate (c) the second wall plate extending parallel to the base of the appliance with the edge zone of the second wall plate facing away from the front, resting against said vertically disposed base plate, and (d) said vertically disposed base plate being movable in planes parallel to the front side of the appliance to permit moving said base plate against said edge zone of the second wall plate.

2. Household appliance according to claim 1, wherein the second wall plate, which is disposed parallel to the base of the appliance has narrow, longitudinal slots, which slots are evenly spaced and which run parallel to the base plate, and wherein said slots extend also over the entire length of the wall plate and are interrupted by separable bridges in the path of every slot.

3. Household appliance according to claim 1. wherein the first wall plate of the facing means has narrow, longitudinal slots, which slots are evenly spaced and which run parallel to the lower edge of the first wall plate, and wherein said slots extend almost over the entire length of the first wall plate and are interrupted by separable bridges in the path of every slot.

4. Household appliance according to claim 2 or 3, wherein the longitudinal slots in said two wall plates of the facing means are offset parallel to the slot axis in the region adjacent to the bridges.

5. Household appliance according to claim 1, wherein the second wall plate which is parallel to the base of the appliance has two vertical posts which are spaced one behind the other, at each of its two end sections, and wherein at least the front-side post engages with a vertical slot which is open toward the front, of the first wall plate of the facing means.

6. Household appliance according to claim 1, wherein an extension of angular cross section extends around the edges of the facing means, and wherein a cover plate is placed in front of said first wall plate.

7. Household appliance according to claim 1, wherein said base plate has evenly spaced holes which are disposed in vertical alignment for inserting screws to fasten the second wall plate of the facing means which extends parallel to the base of the appliance, to the base plate, and wherein said base plate has at its upper edge region, vertical tab-like extensions, which engage in cutouts of a support sheet which is disposed parallel to the base surface of the household appliance and connected to the latter.

8. Household appliance according to claim 1, wherein said base plate is connected at each end of its lower edge to a support shoe, which shoe extends horizontally between the base plate and the household appliance, and is movable longitudinally, and is fastened by screws to the household appliance.

9. Household appliance according to claim 8, wherein the support shoe has detenting means in the form of a wave-shaped region, which extends in the longitudinal direction of the support shoe, and in which detent, a spring engages.

10. Household appliance according to claim 1, wherein the first wall plate of the facing means is connected at the back of its upper edge zone to a ledge which is fastened to the household appliance.

* * * * *

UNITED STATES PATENT OFFICE

CERTIFICATE OF CORRECTION

PATENT NO. : 4,128,287

DATED : December 5, 1978

INVENTOR(S) : FRIEDHELM HORST LOCH et al

It is certified that error appears in the above-identified patent and that said Letters Patent are hereby corrected as shown below:

In the heading to the printed specification,

"June 4, 1976 Germany .... P 26 26 202.8" should read

--June 4, 1976 Germany .... P 26 25 202.8--

Signed and Sealed this

Tenth Day of June 1980

[SEAL]

Attest:

SIDNEY A. DIAMOND

Attesting Officer

Commissioner of Patents and Trademar